US010706834B2

(12) United States Patent
Bernstein

(10) Patent No.: US 10,706,834 B2
(45) Date of Patent: Jul. 7, 2020

(54) SYSTEMS AND METHODS FOR DISABLING ADAPTATION IN AN ADAPTIVE FEEDFORWARD CONTROL SYSTEM

(71) Applicant: Bose Corporation, Framingham, MA (US)

(72) Inventor: Eric Bernstein, Framingham, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/119,702

(22) Filed: Aug. 31, 2018

(65) Prior Publication Data

US 2020/0074977 A1 Mar. 5, 2020

(51) Int. Cl.
*G10K 11/178* (2006.01)

(52) U.S. Cl.
CPC .. *G10K 11/17854* (2018.01); *G10K 11/17823* (2018.01); *G10K 11/17825* (2018.01);
(Continued)

(58) Field of Classification Search
CPC ..... G10K 11/178; G10K 11/17883; G10K 11/17879; G10K 11/17854;
(Continued)

(56) References Cited

U.S. PATENT DOCUMENTS 7,340,064 B2 3/2008 Onishi et al.
7,885,417 B2 2/2011 Christoph
(Continued)

FOREIGN PATENT DOCUMENTS

CN 104952442 9/2015
EP 1414021 5/2008
(Continued)

OTHER PUBLICATIONS

Roure et al., The Remote Microphone Technique for Active Noise Control, Proceedings of Active 99, Dec. 1999, ISSN 0-9622072-2-5, pp. 1233-1244.

(Continued)

*Primary Examiner* — Duc Nguyen
*Assistant Examiner* — Alexander L Eljaiek
(74) *Attorney, Agent, or Firm* — Bond, Schoeneck & King, PLLC

(57) ABSTRACT

A system and method for disabling adaptation in an adaptive feedforward control system at low speeds. The method includes generating a noise signal representative of undesired noise detected by a noise sensor of a vehicle and generating a noise-cancellation signal via a controller within the vehicle. Residual noise resulting from the combination of the acoustic energy of the noise-cancellation signal and the undesired noise is detected by a reference sensor, which generates an error signal based on the residual noise. The error signal and a speed signal from a speed sensor on the vehicle are transmitted to an adaptive processing module for the generation of a filter update signal. The adaptive processing module selectively permits or prevents the filter update signal to adapt filter coefficients of a filter when the speed signal is within a set of conditions.

8 Claims, 2 Drawing Sheets

(52) U.S. Cl.
CPC ..... *G10K 2210/1282* (2013.01); *G10K 2210/3011* (2013.01); *G10K 2210/3027* (2013.01); *G10K 2210/3028* (2013.01); *G10K 2210/501* (2013.01)

(58) Field of Classification Search
CPC ... G10K 2210/1282; G10K 2210/3028; G10K 2210/3016; G10K 2210/3032; G10K 2210/121; G10K 2210/3055; G10K 2210/128; G10K 2210/3027; G10K 2210/501; H04R 2499/13; H04R 3/002; G10L 21/0208
USPC ..... 381/71.11, 94.1, 71.1, 71.4, 86, 71.2, 381/73.1, 94.7, 94.9, 119, 13, 56, 57, 61, 381/71.12, 71.3, 71.9, 98
See application file for complete search history.

(56) References Cited

U.S. PATENT DOCUMENTS

| | | | | |
|---|---|---|---|---|
| 8,077,873 | B2 | 12/2011 | Shridhar et al. | |
| 8,135,140 | B2 | 3/2012 | Shridhar et al. | |
| 8,189,799 | B2 | 5/2012 | Shridhar et al. | |
| 8,199,923 | B2 | 6/2012 | Christoph | |
| 8,199,924 | B2 | 6/2012 | Wertz et al. | |
| 8,204,242 | B2 * | 6/2012 | Pan | G10K 11/178 381/71.11 |
| 8,270,626 | B2 | 9/2012 | Shridhar et al. | |
| 8,315,404 | B2 | 11/2012 | Shridhar et al. | |
| 8,559,648 | B2 | 10/2013 | Christoph | |
| 8,565,443 | B2 | 10/2013 | Wurm | |
| 8,644,521 | B2 | 2/2014 | Christoph et al. | |
| 8,718,289 | B2 | 5/2014 | Shridhar et al. | |
| 8,848,937 | B2 | 9/2014 | Inoue et al. | |
| 9,020,158 | B2 | 4/2015 | Wertz et al. | |
| 9,042,569 | B2 | 5/2015 | Sakamoto et al. | |
| 9,153,226 | B2 | 10/2015 | Wurm | |
| 9,431,001 | B2 | 8/2016 | Cherkassky et al. | |
| 9,445,192 | B2 | 9/2016 | Ueno et al. | |
| 9,478,209 | B2 | 10/2016 | Wurm | |
| 9,596,540 | B2 | 3/2017 | Tani et al. | |
| 9,646,596 | B2 | 5/2017 | Tani et al. | |
| 9,870,763 | B1 | 1/2018 | Christian | |
| 10,235,987 | B1 * | 3/2019 | Valeri | G10K 11/17873 |
| 2004/0258252 | A1 * | 12/2004 | Inoue | G10K 11/178 381/71.4 |
| 2015/0189433 | A1 * | 7/2015 | Ganeshkumar | H04R 3/002 381/71.4 |
| 2015/0356965 | A1 * | 12/2015 | Tani | G10K 11/178 381/71.4 |
| 2016/0314778 | A1 | 10/2016 | Christoph et al. | |
| 2017/0076711 | A1 | 3/2017 | Christoph et al. | |
| 2017/0076712 | A1 | 3/2017 | Christoph | |
| 2017/0110108 | A1 | 4/2017 | Christoph et al. | |
| 2017/0178617 | A1 | 6/2017 | Christoph et al. | |
| 2017/0330551 | A1 | 11/2017 | Zafeiropoulos | |
| 2020/0043461 | A1 * | 2/2020 | Zollner | G10K 11/17879 |

FOREIGN PATENT DOCUMENTS

| | | |
|---|---|---|
| EP | 2375408 | 10/2011 |
| EP | 3147896 | 3/2017 |
| EP | 3156998 | 4/2017 |
| EP | 3157000 | 4/2017 |
| EP | 3157001 | 4/2017 |
| EP | 3159891 | 8/2018 |
| JP | 5990779 | 9/2016 |
| WO | 2018073626 | 4/2018 |

OTHER PUBLICATIONS

Moreau et al., A Review of Virtual Sensing Algorithms for Active Noise Control, Algorithms, 2008, 1, 69-99; DOI: 10.3390/a1020069, ISSN 1999-4893, pp. 69-99.

Oh et. al., Development of Mass Producible ANC System for Broad-Band Road Noise, SAE Technical Paper 2018-01-1561, Jun. 13, 2018, doi:10.4271/2018-01-1561, pp. 1-5.

International Search Report and the Written Opinion of the International Searching Authority, International Application No. PCT/US2019/049026, pp. 1-16, dated Nov. 22, 2019.

* cited by examiner

SYSTEMS AND METHODS FOR DISABLING ADAPTATION IN AN ADAPTIVE FEEDFORWARD CONTROL SYSTEM

BACKGROUND

The present disclosure generally relates to noise control in a vehicle cabin and, more particularly, to systems and methods for disabling adaptation in an adaptive control system.

SUMMARY

All examples and features mentioned below can be combined in any technically possible way.

In one aspect, a noise-cancellation system is provided. The noise-cancellation system includes a noise sensor for providing a noise signal indicative of undesired noise, a controller arranged and configured to generate a noise-cancellation signal and transmit the noise-cancellation signal to a speaker. The speaker transduces the noise-cancellation signal to acoustic energy. A speed sensor is arranged and configured to transmit a speed signal to the controller. The system also includes a reference sensor which is arranged and configured to detect residual noise resulting from the combination of the acoustic energy of the noise-cancellation signal and the undesired noise, and to generate a reference sensor signal based on the detection of residual noise. The system additionally includes an adaptive processing module configured to receive the reference sensor signal and the noise signal, and to generate a filter update signal. An adaptive filter of the system has one or more filter coefficients. The adaptive filter is configured to receive the filter update signal and prevent adjustment of the one or more filter coefficients based on the filter update signal if the speed signal is within a first condition.

In one example, in the first condition, the speed signal indicates a speed below a minimum threshold.

In another example, the adaptive filter is configured to prevent transmission of the noise-cancellation signal to the speaker when the speed signal is within the first condition.

In yet another example, the adaptive filter is configured to permit and increase transmission of the noise-cancellation signal to the speaker in a linear gain or arbitrary gain when the speed signal is within a second condition. In one example, in the second condition, the speed signal indicates a speed between a minimum threshold and a maximum threshold.

In another example, the adaptive filter is configured to allow adjustment of the one or more filter coefficients based on the filter update signal if the speed signal is within a third condition. In yet another, in the third condition, the speed signal indicates a speed above a maximum threshold.

Another aspect features one or more machine-readable storage devices having encoded thereon computer readable instructions for causing one or more processors to perform operations including transmitting a first noise-cancellation signal to a speaker, wherein the speaker transduces the first noise-cancellation signal to acoustic energy; receiving a speed signal of a structure having a predefined volume; preventing adjustment of one or more filter coefficients of an adaptive filter when the speed signal is within at least one of a first condition and a second condition; and adjusting one or more filter coefficients of the adaptive filter when the speed signal is within a third condition, wherein the one or more filter coefficients of the adaptive filter are used to filter a reference sensor signal based on residual noise to generate a second noise-cancellation signal, and wherein the residual noise results from the combination of acoustic energy of each of a first noise-cancellation signal and an undesired noise in the predefined volume.

In one example, in the first condition, the speed signal indicates a speed below a minimum threshold.

In another example, in the second condition, the speed signal indicates a speed between a minimum threshold and a maximum threshold.

In yet another example, in the third condition, the speed signal indicates a speed above a maximum threshold.

In one aspect, the adaptive filter is configured to permit and increase transmission of the second noise-cancellation signal to the speaker in a linear gain or arbitrary gain when the speed signal is within the second condition.

In another aspect, the operations also include preventing transmission of the second noise-cancellation signal to the speaker when the speed signal is within the first condition.

In yet another aspect, the speed signal is transmitted from a sensor of the structure.

In another aspect, a method is provided for reducing an error signal in a vehicle cabin. The method includes the steps of generating a noise signal representative of undesired noise detected by a noise sensor of a vehicle; generating a noise-cancellation signal via a controller within the vehicle; transmitting the noise-cancellation signal to a speaker, wherein the speaker transduces the noise-cancellation signal to acoustic energy emitted into the vehicle cabin; detecting residual noise via a reference sensor in the vehicle cabin, wherein the residual noise results from the combination of the acoustic energy of the noise-cancellation signal and the undesired noise; generating the error signal via the reference sensor based on the residual noise; receiving the error signal and the noise signal at an adaptive processing module of the controller; generating a filter update signal via the adaptive processing module based on the error signal and the noise signal; receiving a speed signal at the adaptive processing module from an accelerometer of the vehicle; preventing adjustment of one or more filter coefficients of an adaptive filter of the controller based on the filter update signal when the speed signal is within at least one of a first condition and a second condition; and adjusting one or more filter coefficients of the adaptive filter when the speed signal is within a third condition.

In one example, the method includes the step of preventing transmission of the noise-cancellation signal to the speaker when the speed signal is within the first condition.

In another example, in the first condition, the speed signal indicates a speed below a minimum threshold.

In one aspect, in the second condition, the speed signal indicates a speed between a minimum threshold and a maximum threshold.

In another aspect, in the third condition, the speed signal indicates a speed above a maximum threshold.

In yet another aspect, the adaptive filter is configured to permit and increase transmission of the noise-cancellation signal to the speaker in a linear gain or arbitrary gain when the speed signal is within the second condition.

The details of one or more implementations are set forth in the accompanying drawings and the description below. Other features, objects, and advantages will be apparent from the description and the drawings, and from the claims.

DETAILED DESCRIPTION

The present disclosure describes various systems and methods for disabling adaptation in an adaptive feedforward control system.

Figure 1:
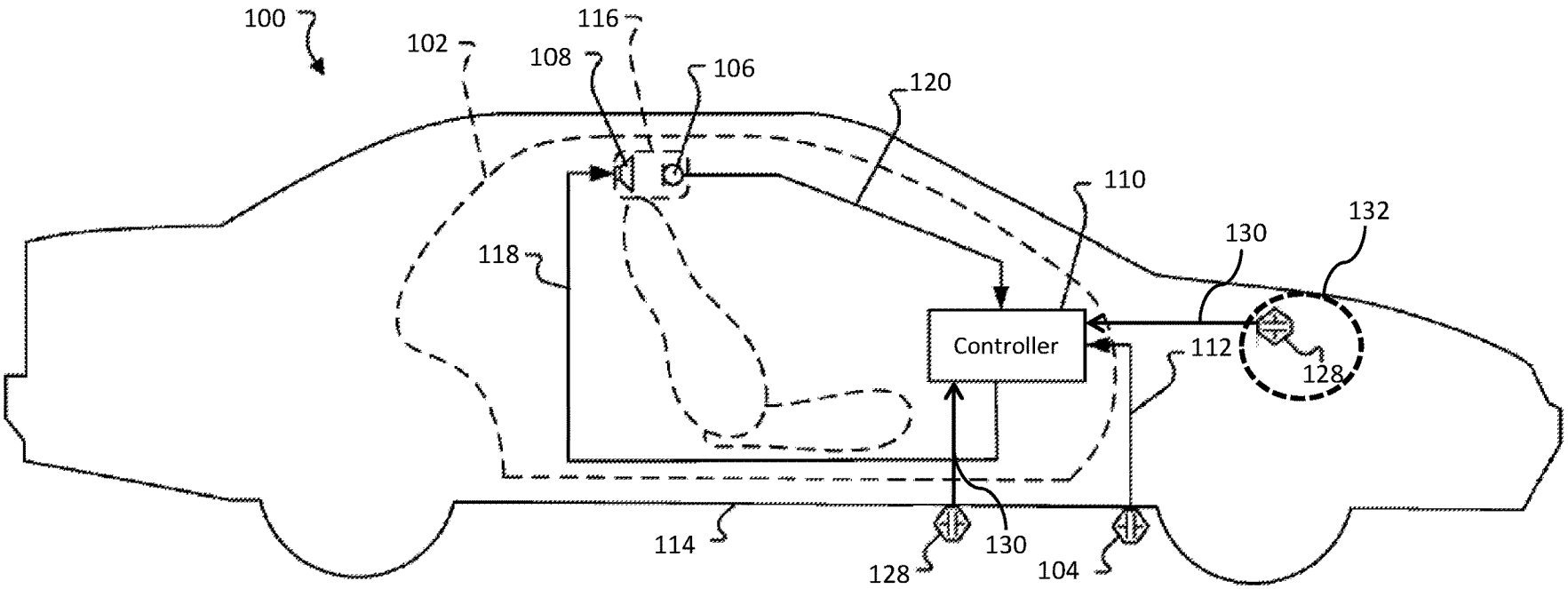
FIG. 1 is a diagram of the noise-cancellation system in a vehicle cabin.

Referring now to the figures, wherein like reference numerals refer to like parts throughout, FIG. 1, is a schematic view of a noise-cancellation system 100 in a vehicle cabin 102. Noise-cancellation system 100 is configured to destructively interfere with undesired sound in at least one cancellation zone within a predefined volume such as a vehicle cabin 102. In an embodiment, the undesired sound is within a predetermined frequency range (e.g., frequencies less than approximately 350 Hz). At a high level, in an embodiment, the noise-cancellation system 100 includes a noise sensor 104, a reference sensor 106, a speaker 108, and a controller 110.

In an embodiment, the noise sensor 104 is configured to generate noise signal(s) 112 representative of the undesired sound, or a source of the undesired sound, within a predefined volume 102. For example, the noise sensor 104 may be an accelerometer mounted to and configured to detect vibrations transmitted through a vehicle structure or body 114. Vibrations transmitted through the vehicle structure 114 are transduced by the structure 114 into undesired sound in the vehicle cabin 102 (perceived as a road noise). Thus, an accelerometer 104 mounted to the structure 114, as shown in FIG. 1, provides a noise signal 112 representative of the undesired sound to the controller 110.

Speakers 108 (or any other electro-acoustic transducer) may, for example, be distributed in discrete locations about the perimeter of the predefined volume 102. In an example, four or more speakers 108 may be disposed within a vehicle cabin 102, each of the four speakers 108 being located within a respective door of the vehicle 114 and configured to project sound into the vehicle cabin 102. In the exemplary embodiment shown in FIG. 1, a speaker 108 is located within a headrest 116 in the vehicle cabin 102.

A command signal—referred to in this application as a noise-cancellation signal 118—may be generated by the controller 110 and provided to one or more speakers 108 in the predefined volume 102. The speakers 108 transduce the noise-cancellation signal 118 to acoustic energy (i.e., sound waves). The acoustic energy produced as a result of noise-cancellation signal 118, is approximately 180° out of phase with—and thus destructively interferes with—the undesired sound within the vehicle cabin 102. The combination of sound waves generated from the noise-cancellation signal 118 and the undesired noise in the predefined volume 102 results in cancellation of the undesired noise, as perceived by a listener in the predefined volume 102.

Reference sensors 106, disposed within the predefined volume 102, generate a reference sensor signal 120 based on detection of residual noise resulting from the combination of the sound waves generated from the noise-cancellation signal 118 and the undesired sound in the predefined volume 102. The reference sensor signal 120 is provided to the controller 110 as feedback. Because the reference sensor signal 120 will represent residual noise, uncancelled by the noise-cancellation signal 120, the reference sensor signal 120 may be understood as an error signal. Reference sensors 106 may be, for example, at least one microphone mounted within a vehicle cabin 102 (e.g., in the roof, headrests 116, pillars, or elsewhere within the cabin 102).

In an embodiment, the controller 110 may comprise a nontransitory storage medium and processor. In an embodiment, the non-transitory storage medium may store program code that, when executed by processor, implements the filter 122 described in connection with FIG. 2. The controller 110 may be implemented in hardware and/or software. For example, the controller 110 may be implemented by an FPGA, an ASIC, or other suitable hardware.

Figure 2:
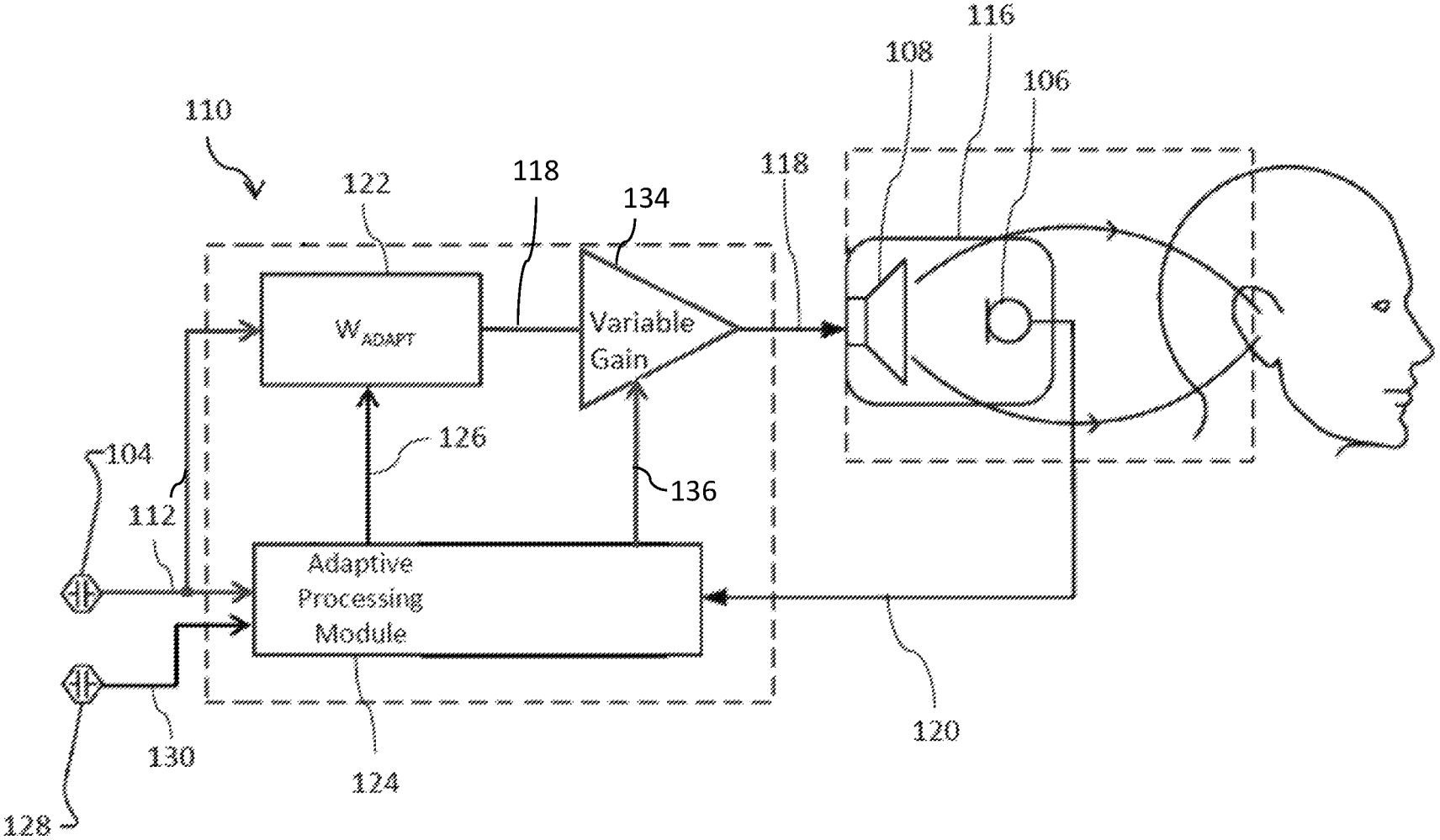
FIG. 2 is a block diagram of the controller of FIG. 1.

Turning to FIG. 2, there is shown a block diagram of the controller 110 of FIG. 1. As shown, the controller 110 may define a control system including filter $W_{ADAPT}$ 122 and an adaptive processing module 124. The adaptive processing module 124 receives, as inputs, the reference sensor signal 120 and the noise signal 112 and, using those inputs, generates a filter update signal 126. The filter update signal 126 is an update to the filter coefficients implemented in filter $W_{ADAPT}$ 122. Thus, the noise-cancellation system 100 executes adaptations or changes in a filter coefficient in a continuous, sample by sample process when a vehicle 114 is in operation.

Filter $W_{ADAPT}$ 122 is configured to receive the filter update signal 126 from the adaptive processing module 124 and to generate noise-cancellation signal 118 based on filter coefficients that may have been updated in accordance with the filter update signal 126. The noise-cancellation signal 118, as described above, is input to speakers 108 where it is transduced into the noise-cancellation audio signal that destructively interferes with the undesired sound in a cancellation zone. Filter $W_{ADAPT}$ 122 may be implemented as any suitable linear filter. For example, filter $W_{ADAPT}$ 122 may be a multi-input multi-output (MIMO) finite impulse response (FIR) filter.

When the vehicle 114 is operating at low speeds, vibrations of the vehicle structure 114 are so low that they are below the noise floor of noise sensor 104 (e.g., accelerometer 104 mounted to and configured to detect vibrations transmitted through the vehicle structure 114). As such, the noise sensor 104 does not detect vibrations when the vehicle 114 is operating at low speeds. However, the noise sensor 104 may detect electronic sensor noise (e.g., an unwanted disturbance in the noise signal 112) and erroneously interpret the electronic sensor noise as vibrations. As such, the noise signal 112 is used by the controller 110 to generate a noise-cancellation signal 118 in response. As the noise signal 112 was based on electronic sensor noise (i.e., not actual vibrations), the noise-cancellation signal 118 is stronger than required. Thus, the residual noise (i.e., difference between the noise-cancellation signal 118 and the noise signal 112) is greater than necessary and is detected by the reference sensor 106. Ultimately, the reference sensor 106 generates a higher (or greater) error signal (i.e., reference sensor signal 120), which is used to generate a filter update signal 126 for adjusting or otherwise updating the filter coefficients implemented in filter $W_{ADAPT}$ 122. When the vehicle 114 then begins to return to higher speeds, the erroneous change to the filter coefficients requires additional adjustment and adaptation to return to correct, reasonable levels to reduce or eliminate actual disturbances (e.g., vibrations). To correct the misinterpretation of electronic sensor noise at low speeds, a low speed turn-off can be utilized.

Using a low speed turn-off, the noise-cancellation system 100 of FIG. 1 can disable or otherwise shut off adaptation when there is no actual road noise. The low speed turn-off operates on the underlying assumption that vehicle speed is correlated to excitation or roughness (e.g., vibrations). In the depicted embodiment, the speed of the vehicle 114 is determined based on an existing speed signal 130 from one or more sensors 128 within or mounted to the vehicle 114 (both configurations shown in FIG. 1). In an embodiment wherein the sensor 128 is within the vehicle, the sensor 128 is located within the engine bay 132. An engine control unit (ECU) (not shown) reads the sensor 128 within the engine bay 132 and transmits a speed signal 130 to a vehicle communication network bus (e.g., a CAN bus) (not shown). The speed signal 130 can be transmitted to or retrieved by components of the controller 110, as described below. In an alternative embodiment, the speed of the vehicle 114 is determined based on energy in the noise signal 112.

The speed signal 130 is received as an input at the adaptive processing module 124. The adaptive processing module 124 determines if the speed of the vehicle 114 is within a set of predetermined condition. The conditions are predetermined in that they are adjustable and fine-tuned taking into consideration various characteristics of the vehicle 114, such as the size of the cabin 102, for example. In an embodiment, there are three predetermined conditions. The first condition occurs when the vehicle 114 is operating at a speed less than a minimum threshold speed. The second condition occurs when the vehicle 114 is operating at a speed within the range of the minimum threshold speed to a maximum threshold speed. The third condition occurs when the vehicle 114 is operating at a speed greater than the maximum threshold speed.

In an exemplary embodiment, the minimum threshold speed is 5 mph. When the system 100 receives a speed signal 130 indicating that the vehicle speed is <5 mph, within the first condition, the noise-cancellation system 100 freezes or otherwise disables adaptation. In particular, the adaptive processing module 124 prevents any changes or updates in the filter coefficients (implemented in filter $W_{ADAPT}$ 122) when the speed signal 130 indicates that the speed of the vehicle 114 is <5 mph. In addition, when the speed signal 130 indicates that the speed of the vehicle 114 is within the first condition, the controller 110 disables or otherwise blocks transmission of the noise-cancellation signal 118 to the speaker 108 in order to prevent uncorrelated electronic sensor noise from being played in the vehicle cabin 102 where it would be audible. Thus, when the speed of the vehicle 114 meets the first condition, there are two effects: (1) preventing adaptation or other alteration to the filter coefficients (implemented in filter $W_{ADAPT}$ 122) and (2) preventing transmission of the noise-cancellation signal 118 to the speaker 108.

Continuing with the exemplary embodiment, the maximum threshold speed is 10 mph. When the adaptive processing module 124 receives a speed signal 130 indicating that the vehicle speed is between 5 mph and 10 mph, within the second condition, the adaptations are still prevented. In other words, when the vehicle speed is within the second condition, the adaptive processing module 124 prevents changes in the filter coefficients (implemented in filter $W_{ADAPT}$ 122), as described above. However, when the vehicle speed is within the second condition, between the minimum and maximum thresholds (e.g., 5 mph and 10 mph, respectively), the controller 110 permits transmission of the noise-cancellation signal 118 to the speaker 108. In an embodiment, shown in FIG. 2, the controller 110 includes a variable gain module 134. The variable gain module 134 adjusts the transmission of the noise-cancellation signal 118 from 0 to 1 when the speed signal 130 indicates that the vehicle speed is between 5 mph and 10 mph, respectively. In particular, the adaptive processing module 124 provides a gain value 136 (e.g., a value from 0 to 1) to the variable gain module 134. The gain value 136 is based on the speed of the vehicle 114 (i.e., the speed signal 130). The variable gain module 134 applies the gain value 136 to the noise-cancellation signal 118 generated by the adaptive filter 122 before transmission of the noise-cancellation signal 118 to the speaker 108.

In an embodiment, transmission of the noise-cancellation signal 118 from the speaker 108 increases as the speed of the vehicle 114 increases within the range of the second condition (e.g., 5 mph-10 mph). In other words, the controller 110 ramps up or otherwise increases the transmission of the noise-cancellation signal 118 to the speaker 108. In one embodiment, the ramp up or increase of transmission of the noise-cancellation signal 118 to the speaker 108 is a linear gain between 0 and 1. Any other gain line (curve) can be used (for example, an arbitrary gain curve) to ramp up the noise-cancellation signal 118 to the speaker 108 as long as the start is at 0 and the end is at 1. Thus, there must be a gain value 136 of 1 when the speed of the vehicle 114 enters the third condition and adaptation begins. The variable gain module 134 reduces audible "pops" or other undesirable noises from the speaker 108 resulting from a transition from no output signal (noise-cancellation signal 118) when the speed of the vehicle 114 meets the first condition (e.g., <5 mph) to a fully enabled system 100 when the speed of the vehicle 114 meets the third condition (e.g., >10 mph).

As stated above, the maximum threshold speed is 10 mph in the exemplary embodiment. When the vehicle 114 is operating at a speed greater than the maximum threshold speed (e.g., 10 mph), the adaptations occur normally. Stated differently, when the speed signal 130 indicates that the vehicle 114 is operating above the maximum threshold, the adaptive processing module 124 permits changes in the filter coefficient (implemented in filter $W_{ADAPT}$ 122). In addition, the ramp up or increase of transmission of the noise-cancellation signal 118 to the speaker 108 when the vehicle speed is within the second condition is complete (i.e., gain of 1) and the noise-cancellation signal 118 is transmitted normally to the speaker 108 when the vehicle speed is within the third condition.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media or storage device, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

While several inventive examples have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive examples described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive examples described herein. It is, therefore, to be understood that the foregoing examples are presented by way of example only and that, within the scope of the appended claims and equivalents thereto, inventive examples may be practiced otherwise than as specifically described and claimed. Inventive examples of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

The invention claimed is:

1. A noise-cancellation system, comprising:

a noise sensor for providing a noise signal indicative of undesired noise;

a controller arranged and configured to generate a noise-cancellation signal and transmit the noise-cancellation signal to a speaker, which transduces the noise-cancellation signal to acoustic energy;

a speed sensor, which is arranged and configured to transmit a speed signal to the controller;

a reference sensor arranged and configured to detect residual noise resulting from the combination of the acoustic energy of the noise-cancellation signal and the undesired noise, and to generate a reference sensor signal based on the detection of residual noise;

an adaptive processing module configured to receive the reference sensor signal and the noise signal, and to generate a filter update signal; and an adaptive filter having one or more filter coefficients, the adaptive filter configured to:

receive the filter update signal;

prevent adjustment of the one or more filter coefficients based on the filter update signal if the speed signal is below a maximum threshold; and prevent transmission of the noise-cancellation signal to the speaker when the speed signal is below a minimum threshold;

wherein the controller is configured to permit and adjust transmission of the noise-cancellation signal to the speaker in a linear gain or arbitrary gain when the speed signal is between the minimum threshold and the maximum threshold, and wherein the noise-cancellation signal is adjusted based on the speed signal.

2. The noise-cancellation system of claim 1, wherein the controller is configured to allow adjustment of one or more filter coefficients based on the filter update signal if the speed signal is within a third condition.

3. A noise-cancellation system of claim 2, wherein in the third condition, the speed signal indicates a speed above a maximum threshold.

4. One or more non-transitory machine-readable storage devices having encoded thereon computer readable instructions for causing one or more processors to perform operations comprising:

transmitting a first noise-cancellation signal to a speaker, wherein the speaker transduces the first noise-cancellation signal to acoustic energy;

receiving a speed signal of a structure having a predefined volume;

preventing adjustment of one or more filter coefficients of an adaptive filter when the speed signal is below a maximum threshold;

preventing transmission of the second noise-cancellation signal to the speaker when the speed signal is below a minimum threshold;

permitting and adjusting transmission of the second noise-cancellation signal to the speaker in a linear gain or arbitrary gain when the speed signal is between the minimum threshold and the maximum threshold, and wherein the noise-cancellation signal is adjusted based on the speed signal; and adjusting one or more filter coefficients of the adaptive filter when the speed signal is within a third condition, wherein the one or more filter coefficients of the adaptive filter are used to filter a reference sensor signal based on residual noise to generate a second noise-cancellation signal, and wherein the residual noise results from the combination of acoustic energy of each of a first noise-cancellation signal and an undesired noise in the predefined volume.

5. The one or more machine-readable storage devices of claim 4, wherein in the third condition, the speed signal indicates a speed above a maximum threshold.

6. The one or more machine-readable storage devices of claim 4, wherein the speed signal is transmitted from a sensor of the structure.

7. A method for lowering an error signal in a vehicle cabin, comprising the steps of:

generating a noise signal representative of undesired noise detected by a noise sensor of a vehicle;

generating a noise-cancellation signal via a controller within the vehicle;

transmitting the noise-cancellation signal to a speaker within the vehicle, wherein the speaker transduces the noise-cancellation signal to acoustic energy emitted into the vehicle cabin;

detecting residual noise via a reference sensor in the vehicle cabin;

wherein the residual noise results from the combination of the acoustic energy of the noise-cancellation signal and the undesired noise;

generating the error signal via the reference sensor based on the residual noise;

receiving the error signal and the noise signal at an adaptive processing module of the controller;

generating a filter update signal via the adaptive processing module based on the error signal and the noise signal;

receiving a speed signal at the adaptive processing module from an accelerometer of the vehicle;

preventing adjustment of one or more filter coefficients of an adaptive filter of the controller based on the filter update signal when the speed signal is below a maximum threshold;

preventing transmission of the noise-cancellation signal to the speaker when the speed signal is below a minimum threshold;

permitting and adjusting transmission of the second noise-cancellation signal to the speaker in a linear gain or arbitrary gain when the speed signal is between the minimum threshold and the maximum threshold, and wherein the noise-cancellation signal is adjusted based on the speed signal; and adjusting one or more filter coefficients of the adaptive filter when the speed signal is within a third condition.

8. The method of claim 7, wherein in the third condition, the speed signal indicates a speed above a maximum threshold.

* * * * *